US009360240B2

(12) United States Patent
Höjer et al.

(10) Patent No.: US 9,360,240 B2
(45) Date of Patent: Jun. 7, 2016

(54) THERMOELECTRIC ASSEMBLY

(71) Applicant: Laird Technologies, Inc., Earth City, MO (US)

(72) Inventors: Henrik Höjer, Kungälv (SE); Anders Thorén, Göteborg (SE); Dan Martin Gustav Karlstedt, Torslanda (SE)

(73) Assignee: Laird Technologies, Inc., Earth City, MO (US)

( * ) Notice: Subject to any disclaimer, the term of this patent is extended or adjusted under 35 U.S.C. 154(b) by 0 days.

(21) Appl. No.: 14/661,933

(22) Filed: Mar. 18, 2015

(65) Prior Publication Data

US 2015/0192332 A1 Jul. 9, 2015

Related U.S. Application Data

(63) Continuation of application No. PCT/US2012/064375, filed on Nov. 9, 2012.

(51) Int. Cl.
*F25B 21/04* (2006.01)

(52) U.S. Cl.
CPC ..... *F25B 21/04* (2013.01); *F25B 2321/023* (2013.01); *F25B 2321/0251* (2013.01)

(58) Field of Classification Search
CPC ..... F25B 21/04; F25B 2321/023; F25B 2321/0251; H01L 2924/0002; H01L 2924/00; H01L 2321/023
USPC ..... 62/3.2, 3.3, 3.7
See application file for complete search history.

(56) References Cited

U.S. PATENT DOCUMENTS

| | | | |
|---|---|---|---|
| 4,782,664 | A | 11/1988 | Sterna et al. |
| 6,058,712 | A | 5/2000 | Rajasubramanian et al. |
| 6,530,231 | B1 | 3/2003 | Nagy et al. |
| 6,946,600 | B1 | 9/2005 | Stoller et al. |
| 7,929,294 | B2 | 4/2011 | Yeh et al. |

(Continued)

FOREIGN PATENT DOCUMENTS

| | | |
|---|---|---|
| JP | H11294891 | 10/1999 |
| JP | 2012-004454 | 1/2012 |

(Continued)

OTHER PUBLICATIONS

International Search Report and Written Opinion dated Aug. 14, 2013 for PCT Application No. PCT/US2012/064375 (published as WO 2014/074110) which is the parent application to the instant application; 11 pages.

(Continued)

*Primary Examiner* — Mohammad M Ali
(74) *Attorney, Agent, or Firm* — Harness, Dickey & Pierce, P.L.C.

(57) ABSTRACT

A thermoelectric assembly is disclosed, the assembly having a cold side and a hot side, where the hot side comprises a single fan sink and the cold side comprises dual fan sinks. Thermoelectric modules may be between the hot side and cold side and arranged in one circuit or multiple parallel circuits, and in direct thermal contact with both the hot side and the cold side. The assembly may include one or more moisture barrier measures, including a wire seal, a series of screw O-rings, and a sealing layer.

20 Claims, 13 Drawing Sheets

(56) References Cited

U.S. PATENT DOCUMENTS

| | | | | |
|---|---|---|---|---|
| 8,484,983 | B2 | 7/2013 | Gao et al. | |
| 8,704,076 | B2 | 4/2014 | Braun et al. | |
| 8,978,392 | B2 | 3/2015 | Blackway et al. | |
| 8,997,502 | B2 | 4/2015 | Ayres et al. | |
| 2005/0000231 | A1* | 1/2005 | Lee | A41D 13/0025 62/3.5 |
| 2007/0041877 | A1* | 2/2007 | Maurer | G01N 21/0332 422/400 |
| 2007/0119186 | A1* | 5/2007 | Kitchens | F25B 21/02 62/3.3 |
| 2007/0183772 | A1* | 8/2007 | Baldwin | G03B 29/00 396/439 |
| 2010/0031988 | A1* | 2/2010 | Bell | F02G 1/043 136/200 |
| 2010/0037626 | A1* | 2/2010 | Liebmann | F25B 21/04 62/3.3 |
| 2010/0319627 | A1* | 12/2010 | Cauchy | A01K 1/0236 119/500 |
| 2011/0016886 | A1* | 1/2011 | Ghoshal | F25B 21/02 62/3.2 |
| 2011/0197596 | A1* | 8/2011 | Cheng | F28D 15/00 62/3.2 |
| 2012/0055170 | A1* | 3/2012 | Lilke | F24F 5/0042 62/3.3 |
| 2014/0165603 | A1 | 6/2014 | Boarman et al. | |
| 2014/0260330 | A1 | 9/2014 | Karlstedt | |

FOREIGN PATENT DOCUMENTS

| | | |
|---|---|---|
| KR | 10-2004-0045667 | 6/2004 |
| KR | 10-0789945 | 1/2008 |
| KR | 10-1125151 | 3/2012 |
| WO | WO 2014/074110 | 5/2014 |

OTHER PUBLICATIONS

Thermoelectric Products Catalogue; Crystal Ltd., www.crystal-ltherm.com, 2012, 32 pages.

Supplemental European Search Report dated Oct. 2, 2015 for European Application No. 2888184 filed Apr. 1, 2015 (published as 2891176 on Jul. 8, 2015) which claims priority to the same parent application as the instant application; 3 pages.

* cited by examiner

THERMOELECTRIC ASSEMBLY

CROSS-REFERENCE TO RELATED APPLICATION

This patent application is a continuation of and claims the benefit of International Application No. PCT/US2012/064375 filed Nov. 9, 2012 (published as WO2014/074110 on May 15, 2014). The disclosure of the application identified in this paragraph is incorporated herein by reference in its entirety.

FIELD

The present disclosure relates to thermoelectric assemblies.

BACKGROUND

This section provides background information related to the present disclosure which is not necessarily prior art.

The Peltier effect is an effect in which a heat flux is created between the junction of two different types of materials. Thermoelectric modules (TEMs) are semiconductor devices which use the Peltier effect to transfer heat from one side of the TEM (the "cold side") to the other side of the TEM (the "hot side"). The TEM, a solid-state Peltier device, effectively acts as a heat pump upon the application of a DC power source to the TEM. Heat is moved through the TEM, from one side to the other, with consumption of electrical energy, depending on the direction of the current. Such an instrument may also be called a Peltier cooler or heater, a thermoelectric heat pump, a Peltier heat pump, a solid state refrigerator, a thermoelectric cooler (TEC), or a thermoelectric module (TEM). TEMs can be used either for heating or for cooling (refrigeration), although in practice the main application is cooling.

Thermoelectric assemblies (TEAs) often include a pair of fan sinks that face outwardly in opposite directions and meet at one or more TEMs at their bases. As can be seen in FIGS. 1A & 1B, which represent an example of the prior art, a TEA may comprise a cold side fan sink, a hot side fan sink, and a plurality of TEMs disposed between the fan sinks. A cold side fan sink typically includes a fan mounted on a heat sink, often through the use of a fan housing over the heat sink fins. The TEA may also include a gasket, often made of a foam, that surrounds the TEMs that are in contact with the base of the cold side heat sink. The TEMs are typically arranged in one or more parallel circuits. A hot side fan sink is analogous to the cold side fan sink, and the two fan sinks are both in thermal contact with the TEMs and the gasket at the heat sink bases.

SUMMARY

This section provides a general summary of the disclosure, and is not a comprehensive disclosure of its full scope or all of its features.

In one aspect, a thermoelectric assembly has a cold side and a hot side. The boundary between the hot side and the cold side may be generally defined by a plane. One or more thermoelectric modules may be in the plane and arranged in one circuit or multiple parallel circuits, and in direct thermal contact with both the hot side and the cold side.

The hot side comprises a single fan sink, whereas the cold side comprises a pair of fan sinks. A fan sink is a heat sink and a fan, each fan comprising a blade, and each heat sink comprising a fin set, where a fin set is a series of parallel protrusions on a heat sink base, the parallel protrusions aligned in a single exhaust direction.

In an embodiment, each fan sink possesses an air intake direction defined by an axis about which the blade is rotatably attached to the fan, and the air intake direction is at an angle of ninety degrees from the air exhaust direction. The air intake directions of the pair of fan sinks on the cold side are parallel. Further, the angle defined by the air exhaust directions of the pair of fan sinks on the cold side may be selected from the group consisting of zero degrees, ninety degrees, and one hundred eighty degrees.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1A:
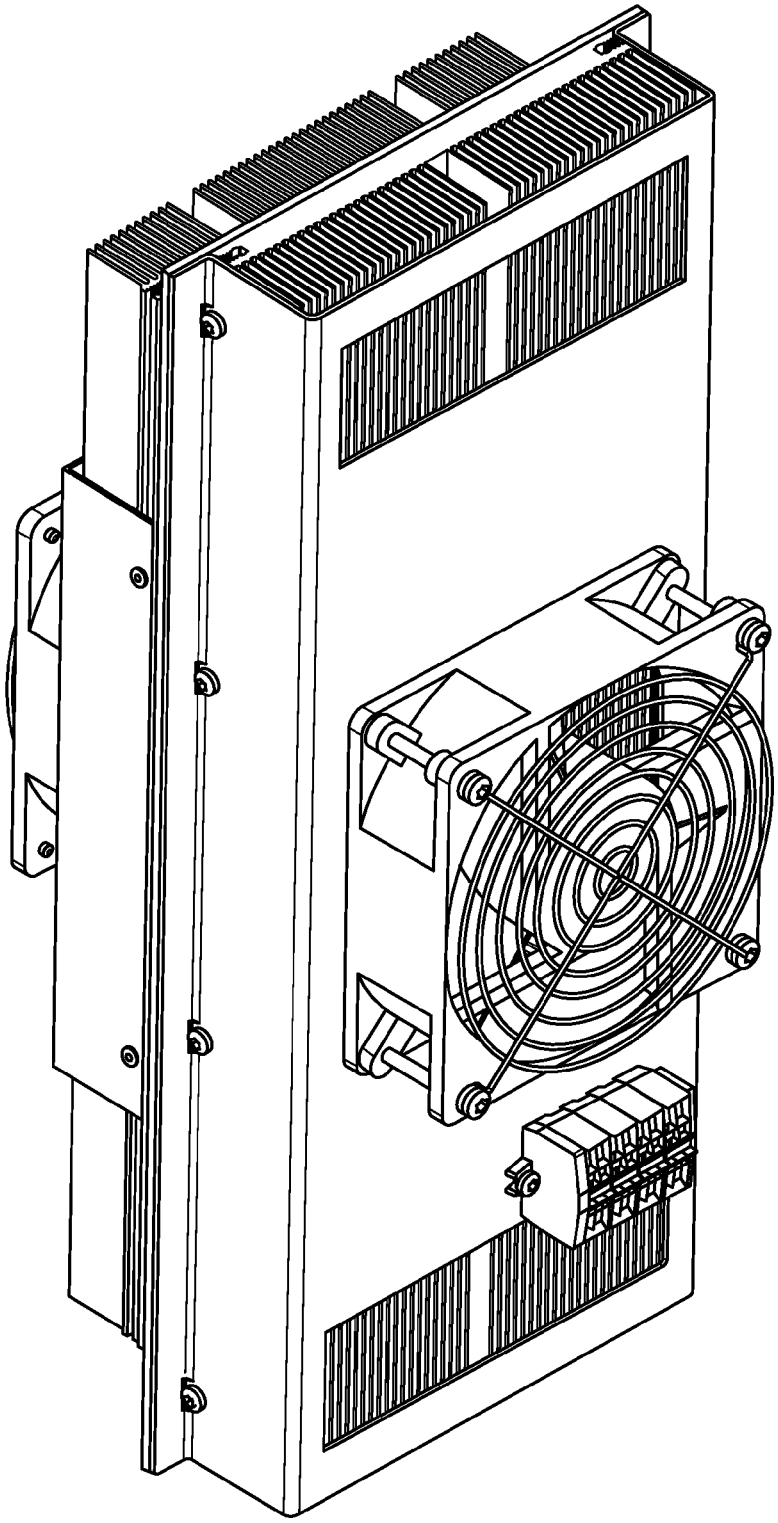
FIG. 1A (Prior Art)
FIG. 1A shows a perspective view of one side of a thermoelectric assembly of the prior art.
Figure 1B:
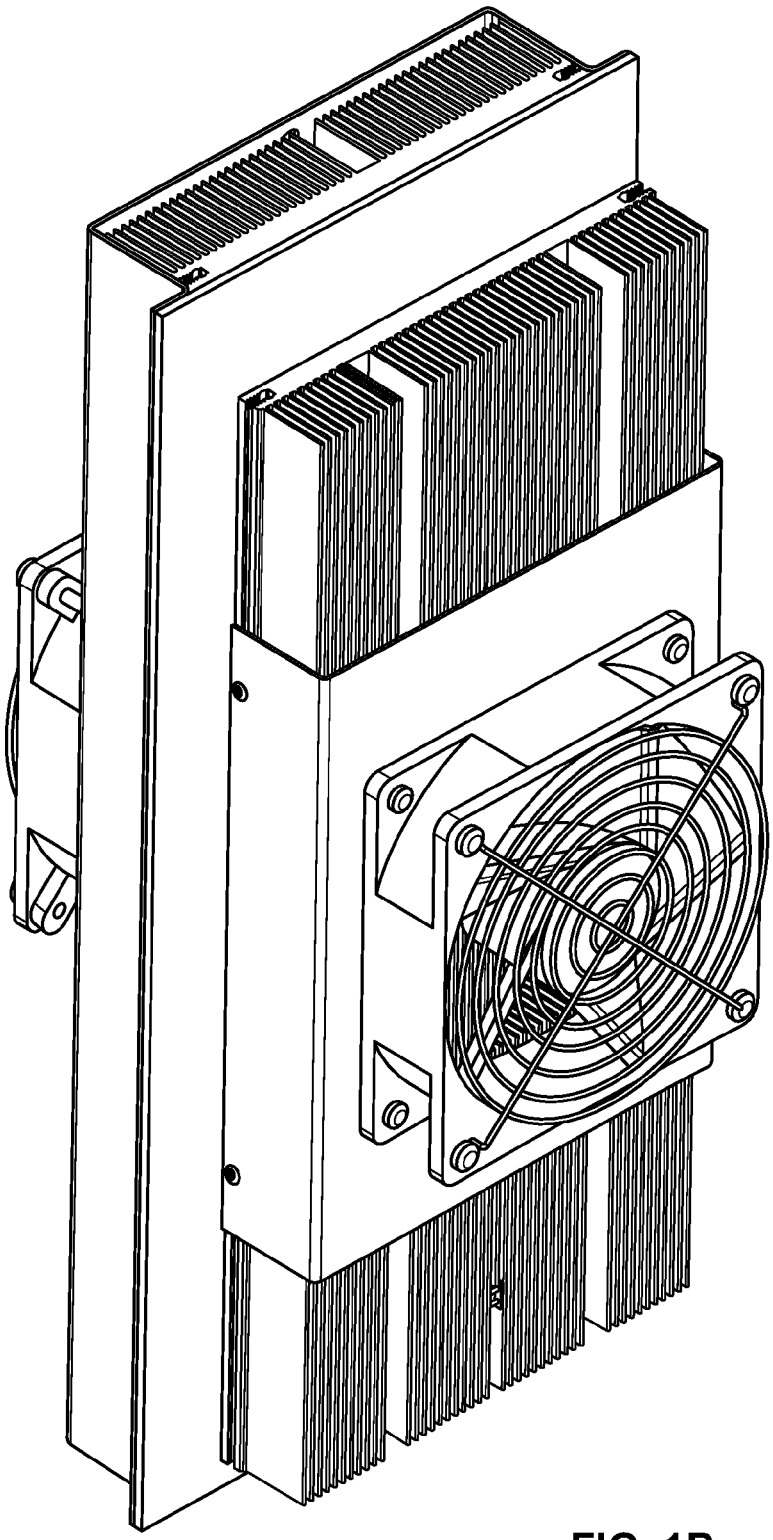
FIG. 1B (Prior Art)
FIG. 1B shows a perspective view of the other side of the thermoelectric assembly of the prior art seen in FIG. 1A.

Exemplary embodiments will now be described more fully with reference to the accompanying drawings.

TEAs operate generally as follows: On the cold side, the fan pulls the surrounding air into the heat sink channels that are defined by the space between the heat sink fins, thereby drawing substantial ambient air over the cold side fins to facilitate an eventual air-to-metal thermal transfer on the cold side. The TEMs are in physical thermal contact with the bases of the heat sinks. The TEMs pump thermal energy from the cold side heat sink base onto the base of the hot side heat sink. As the hot side heat sink warms due to the heat pumped into them by the TEMs, the hot side fan cools the fins of the hot side heat sink by drawing ambient air across them and expelling warm air from the hot side air channels. In essence, the TEMs pump heat from one side of the unit to the other while the fan sinks provide substantial surface area and air flow therethrough to enable an efficient heat transfer.

A frequent problem in the art arises from the condensation that accumulates on the cold side heat sink during operation of the thermoelectric assembly. As the temperature of the cold side heat sink dips below the dew point of the ambient air around the cold side during the operation of the assembly, moisture accumulates on the exposed surface of the cold side heat sink. This condensation can create performance issues, reduce effective surface area of the heat sink fins, and give rise to water-borne organic growth that can cause foul odors, among other problems.

Frequently, a TEA is to be installed on the vertical walls of a pre-existing structure, as opposed to installation as a part of a new construction. Due to the existing conditions of the structure, such as the placement of doors, windows, studs, wiring, vents, etc., the TEA may need to be installed with the heat sink fins running horizontally as opposed to vertically. Where the heat sink fins are horizontal, condensation moisture control is difficult to achieve with a fan alone, whereas a vertical heat sink fin arrangement may be more efficiently drained of condensate with the assistance of gravity.

Additionally, condensation moisture may permeate the interior of the TEA through holes in the heat sink used for wiring or bolts/screws. This moisture can cause performance issues on the assembly, including potentially shorting out one or more of the parallel TEM circuits or other electrical components of the unit.

Fan sinks are known mechanisms for forced air convection, which provides a more efficient air-to-metal or metal-to-air thermal transfer. Additionally, the forced convection mechanism aids in preventing oxidation of the heat sink material through the continuous movement of ambient air.

Thermoelectric modules are essentially solid state heat pumps comprising positively and negatively doped modules. They may be arranged in a single series circuit or in several parallel circuits, or any combination thereof. In non-limiting embodiments, for example where eight TEMs are present in the TEA, the TEMs may be arranged in four parallel circuits of two series connected TEMs, two parallel circuits of four series connected TEMs, or eight separate TEMs each on a single circuit.

In one aspect, a TEA comprising a hot side and a cold side is disclosed, where the cold side comprises two or more fan sinks, while the hot side comprises a single fan sink. A TEA may be mounted on a vertical surface of an enclosure, such as a wall, to provide cooling of the ambient air on one side of the enclosure wall through the transfer of heat to the other side of the enclosure wall.

As referred to herein, the terms hot side and cold side do not necessarily indicate one side as literally "hot" or "cold." Rather, an aim of the TEA disclosed herein is to transfer heat from the cold side to the hot side, thereby providing a relative cooling to the cold side. For example, a rooftop electrical service room with a TEA device installed would transfer heat from the warm inside to the potentially cooler ambient outside. Conversely, a TEA device installed on an indoor wine cooler or wine chiller that is colder than the surrounding ambient room temperature would be cooled by transferring heat from the cooler cold side to the warmer hot side. As such, the terms hot side and cold side are not intended to be limiting in the sense that the sides are literally hot or cold, but merely intended to show an embodiment of potential thermal flow of a TEA.

Additionally, the TEA may include a series of moisture barrier measures that, when used in concert and installed on a TEA, substantially eliminate the moisture problems seen in the art. Primarily, these moisture barrier measures include a sealing layer in or near the plane that defines the hot and cold sides, an O-ring sealed screw joint, and a moisture protected wire seal. Each of these individually may be considered a suitable means for moisture protection. In an embodiment, each of the sealing layer, screw joint, and wire seal together comprise a comprehensive moisture barrier system.

Figure 2A:
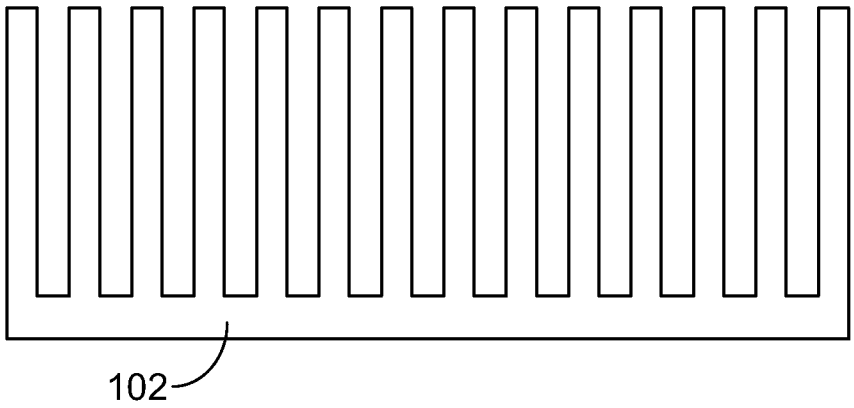
FIG. 2A shows a cross sectional example of a single piece heat sink.
Figure 2B:
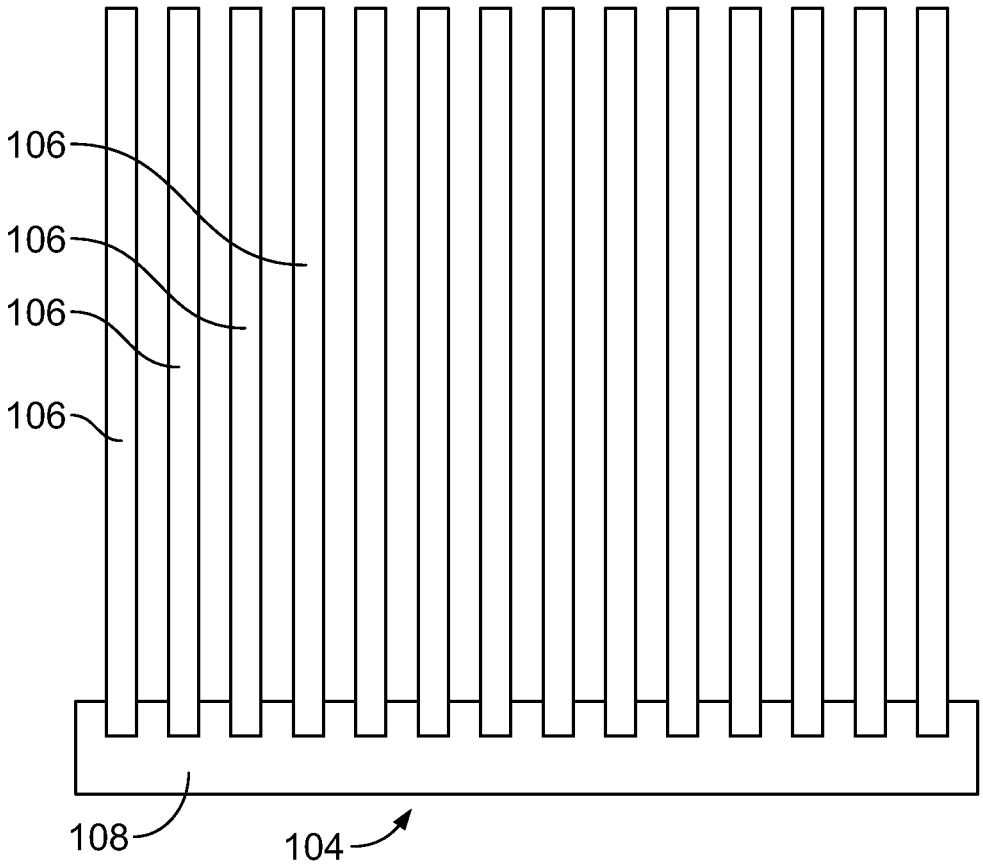
FIG. 2B shows a cross sectional example of a multi-piece heat sink.

Though heat sinks are not so limited in shape, heat sinks suitable for use in TEA generally comprise a rectangular base upon which a series of fins, referred to as a fin set, protrude. Fins may be substantially parallel panels of material, often the same material as the base. Two exemplary types of heat sinks can be seen in FIGS. 2A and 2B. FIG. 2A shows a cross section of a single piece or one-piece heat sink 102. Conversely, FIG. 2B shows a cross section of a multi piece heat sink 104, where the multi piece heat sink comprises a series of fins 106 that have been mounted on a base 108.

As seen in FIG. 2A, a heat sink may be a block of metal, such as copper or anodized aluminum, or thermoelectric material, such as thermally-conductive polymer composites, that has, for example, been skived, molded, or extruded to create a series of parallel ribs on a base. In certain instances, such as where the desired rib height is substantial enough that skiving of the entire heat sink is inappropriate, a heat sink base may be constructed of a skived, extruded, or molded base, whereupon individual fins are mounted within the skived recesses of the heat sink base, as seen in FIG. 2B. In an embodiment where the heat sink is comprised of a thermally-conductive polymer composite, the heat sink may be made through injection molding or thermoset molding. A multi-piece heat sink may be needed if, for example, an application requires fins of such a depth that skiving is not practical. In either case, the fan sinks of a TEA may be suitable for either a single piece heat sink or a multi-piece heat sink.

A fan sink generally comprises a heat sink and a fan. An exemplary fan sink can be seen as a component of the thermoelectric assembly of FIG. 3. Each fan comprises a blade that rotates about an axis. The fan is mounted on or near a heat sink and pulls air through each fan and onto and through the heat sink fin set. The air flows into the heat sink channels that are defined by the space between the heat sink fins. Each fan sink possesses an air intake direction defined by the axis about which the blade is rotatably attached to the fan. Similarly, each fan sink comprises an exhaust direction that is perpendicular to the intake direction and generally parallel to the linear arrangement of the fin set. A heat sink may have a greater width than its corresponding fan.

Figure 3:
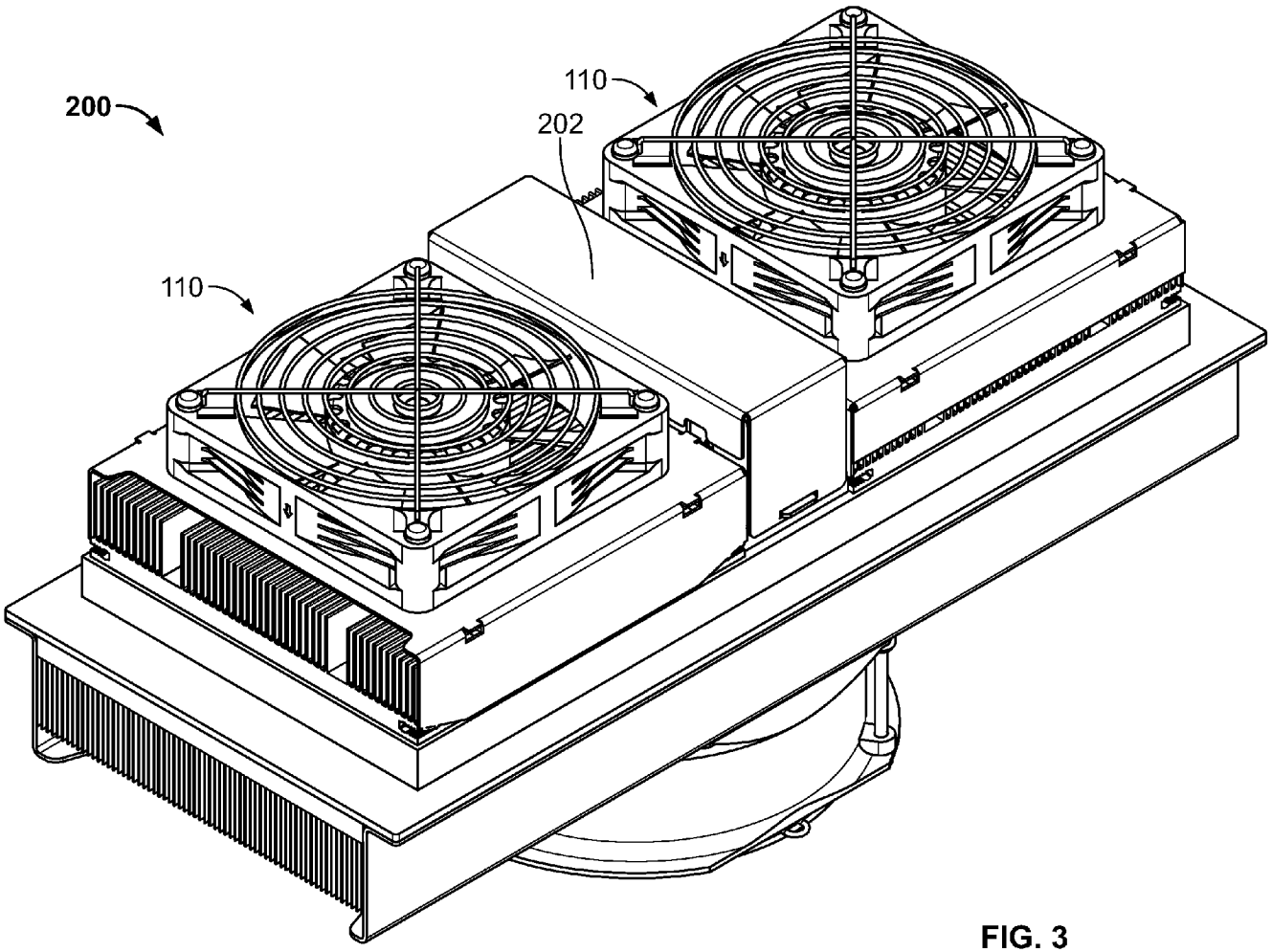
FIG. 3 shows a perspective view of an embodiment of a thermoelectric assembly, this view showing a pair of cold side fan sinks.

Referring further to the Figures, FIG. 3 shows an embodiment of a thermoelectric assembly 200 having dual cold side fan sinks 110. Comparing FIGS. 1A and 1B to FIG. 3, the space between the dual cold side fan sinks 110 in FIG. 3 has permitted the placement of an electric bay 202 between the two fan sinks. Conversely, the electrical connections of the prior art TEA of FIG. 1A is exposed and susceptible to moisture issues. As seen in FIG. 3, the electric bay 202 may be a centralized housing containing electrical components and connections.

Figure 4A:
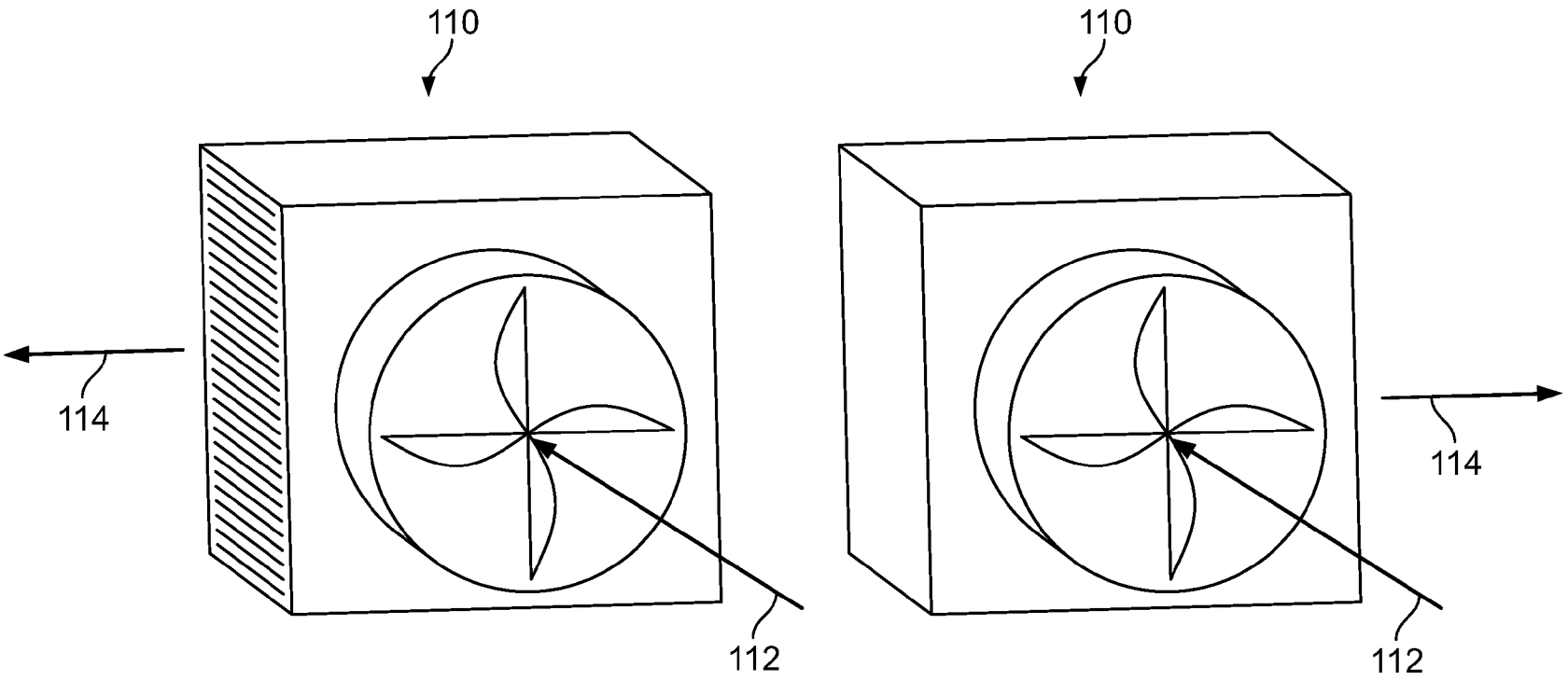
FIG. 4A shows an embodiment of the air flow configuration of the cold side fan sinks, this embodiment showing the 180° air flow differential.
Figure 4B:
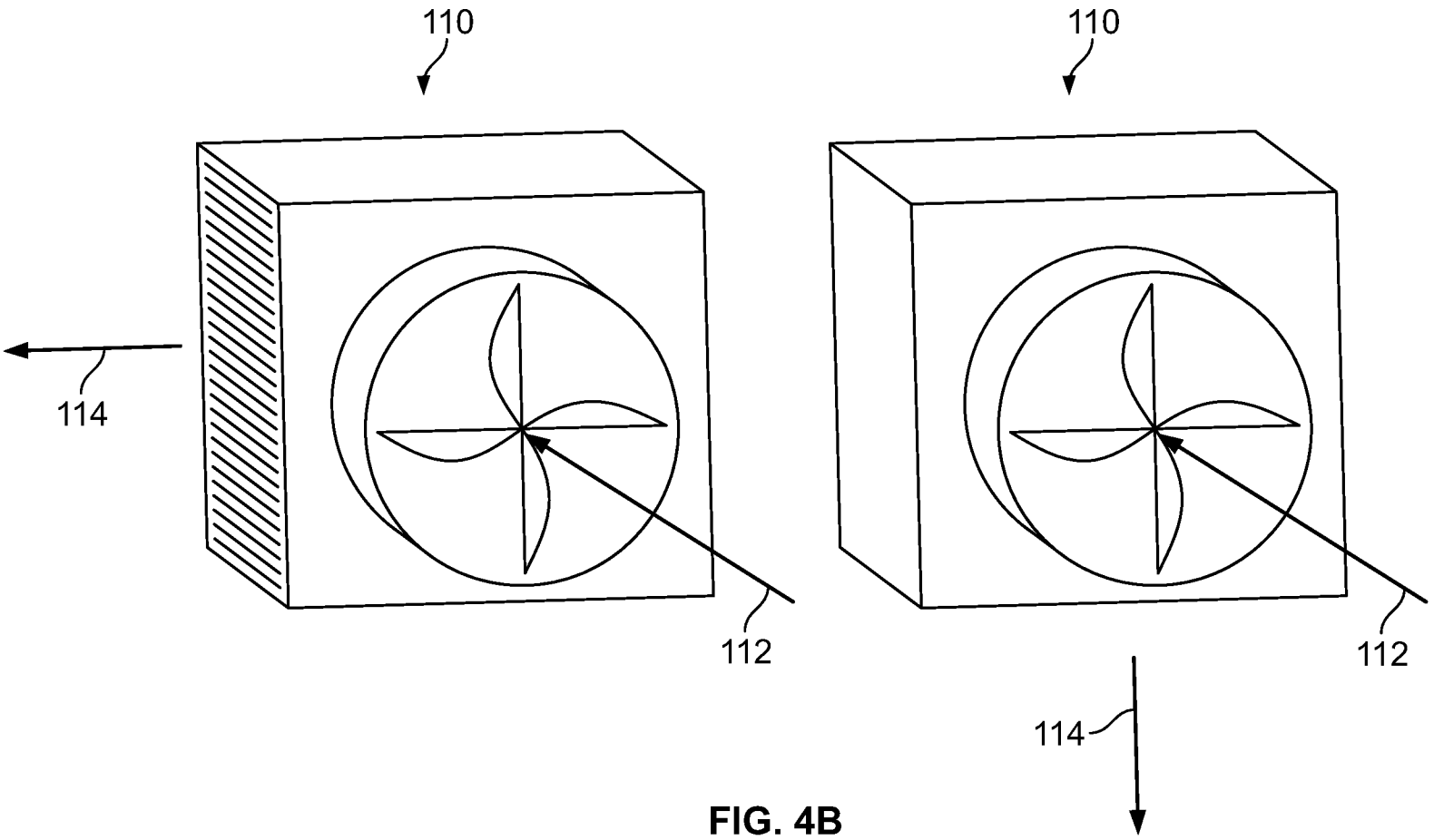
FIG. 4B shows an embodiment of the air flow configuration of the cold side fan sinks, this embodiment showing the 90° air flow differential.
Figure 4C:
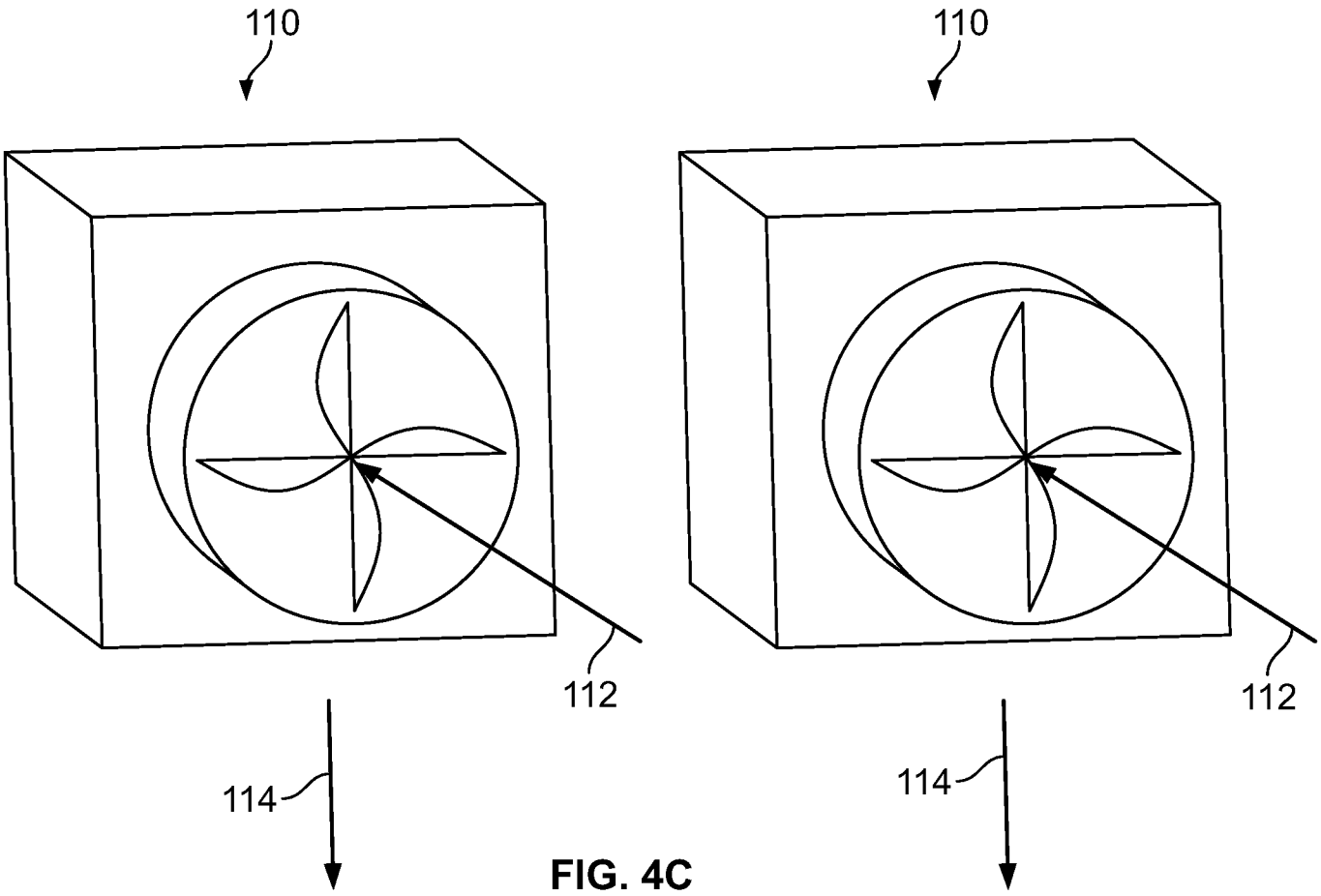
FIG. 4C shows an embodiment of the air flow configuration of the cold side fan sinks, this embodiment showing the 0° air flow differential.

Referring now to FIGS. 4A, 4B, and 4C, two fan sinks 110 may be aligned next to one another such that the two fan sinks have air intake directions 112 that are parallel and in the same direction. The fan sinks 110 may be arranged, however, such that their exhaust directions 114 are parallel or perpendicular to one another, and so that each fan sink has a single exhaust direction and one fan sink does not blow exhaust air on the other. In this manner, bi-directional configurable air flow is possible on the cold side of a TEA. Specifically, FIG. 4A depicts two fan sinks 110 that have exhaust directions 114 represented by opposite vectors, at 180 degrees from one another, while the intake directions 112 are represented by parallel vectors. FIG. 4B depicts two fan sinks 110 with exhaust directions 114 represented by vectors that are perpendicular to one another, at 90 degrees from one another. FIG. 4C depicts two fan sinks 110 with exhaust directions 114 that are represented by parallel vectors but are zero degrees from one another. This flexibility and modular configurations of the fan sinks 110 seen in FIGS. 4A, 4B, and 4C is not seen in the thermoelectric assemblies of the prior art. Note that the embodiment of the thermoelectric assembly 200 of FIG. 3 shows the 90 degree configuration of FIG. 4B.

Figure 5:
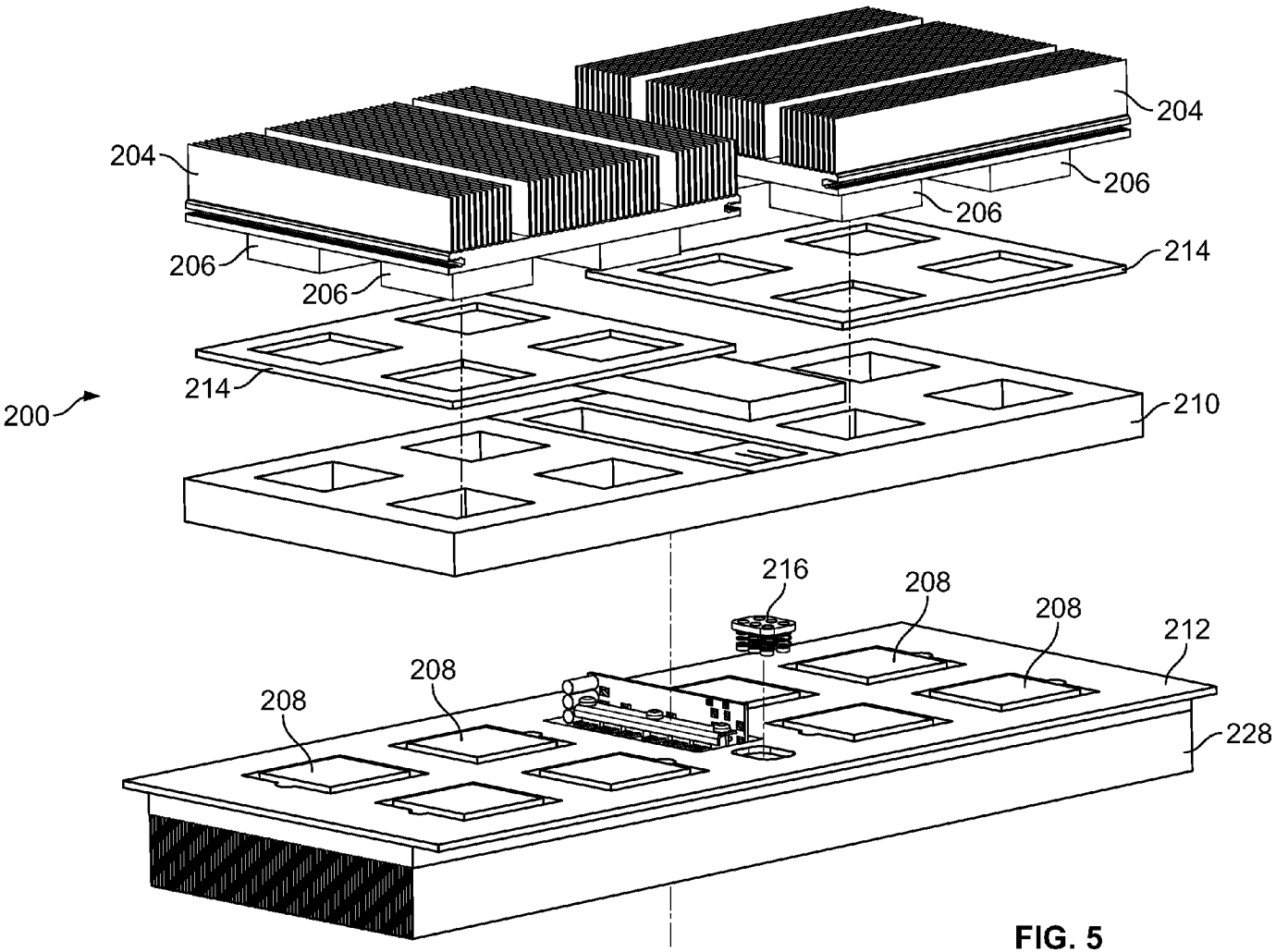
FIG. 5 shows an exploded perspective view of an embodiment of a thermoelectric assembly with a sealing layer, as well as an embodiment of the moisture protection screw lead.

FIG. 5 shows an exploded perspective view of an exemplary thermoelectric assembly 200, including moisture barrier measures. FIG. 5, in the interest of clarity, shows dual cold side heat sinks 204 without their respective fans, as well as a single large hot side heat sink 228 without a fan. FIG. 5 more clearly illustrates the plane that generally defines the hot and cold sides of the TEA, within which the TEMs reside.

Further, the cold side heat sinks 204 of FIG. 5 comprise generally square protrusions 206 that descend from the base of the heat sink. The TEMs 208 are in thermal contact with the bases of the heat sinks. As seen in the exploded view of FIG. 5, the TEMs 208 would be in direct thermal contact with the protrusions 206 of the cold side heat sinks 204. However, the TEMs 208 would be in direct thermal contact with a flush planar base of a large cold side heat sink 228.

FIG. 5 additionally shows an insulation gasket 210. Insulation gaskets, as can be seen in FIG. 5, may be die cut or otherwise cut to permit the heat sink protrusions 206 to pass therethrough and make contact with the TEMs 208. This improves TEA efficiency as an insulating material, forming a perimeter seal around the protrusions. Insulation gaskets may be made of any suitable material known in the art, including semi-closed or closed cell foam such as neoprene. Once the TEA is fully assembled, however, frequently the semi-closed foam's cell structure is compressed to form a completely closed cell structure, thereby improving efficiency and partially reducing moisture permeation. Another thinner insulation gasket 212 may be added around the TEMs 208 to serve generally the same purpose as the larger insulation gasket 210.

Improving upon the insulation gasket 210, however, it was found that adding additional sealing layers 214 for each cold side heat sink 204, particularly those with protrusions 206, to pass through to the TEMs 208 further reduced moisture penetration. Traditional insulation gaskets are not flexible enough to seal around the heat sinks at their base, particularly because the bases of heat sinks can be rough from skiving or other manufacturing processes. By adding additional semi-closed or closed foam cell insulation to the TEAs, the TEA may be further sealed against moisture permeation.

Figure 6A:
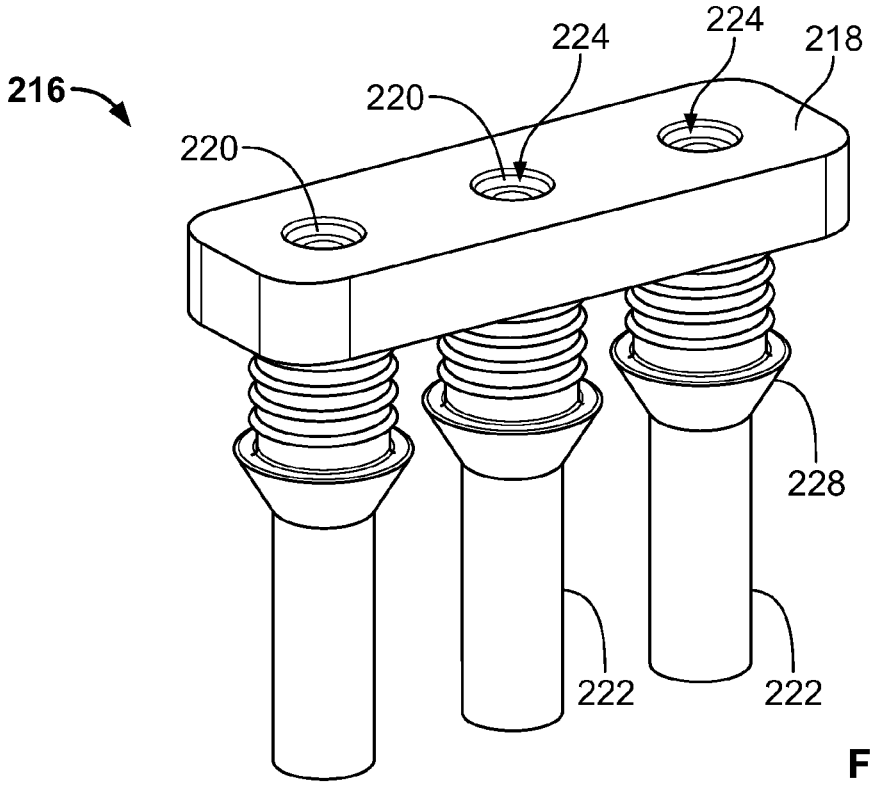
FIG. 6A shows a perspective view of an embodiment of the moisture protection screw lead.
Figure 6B:
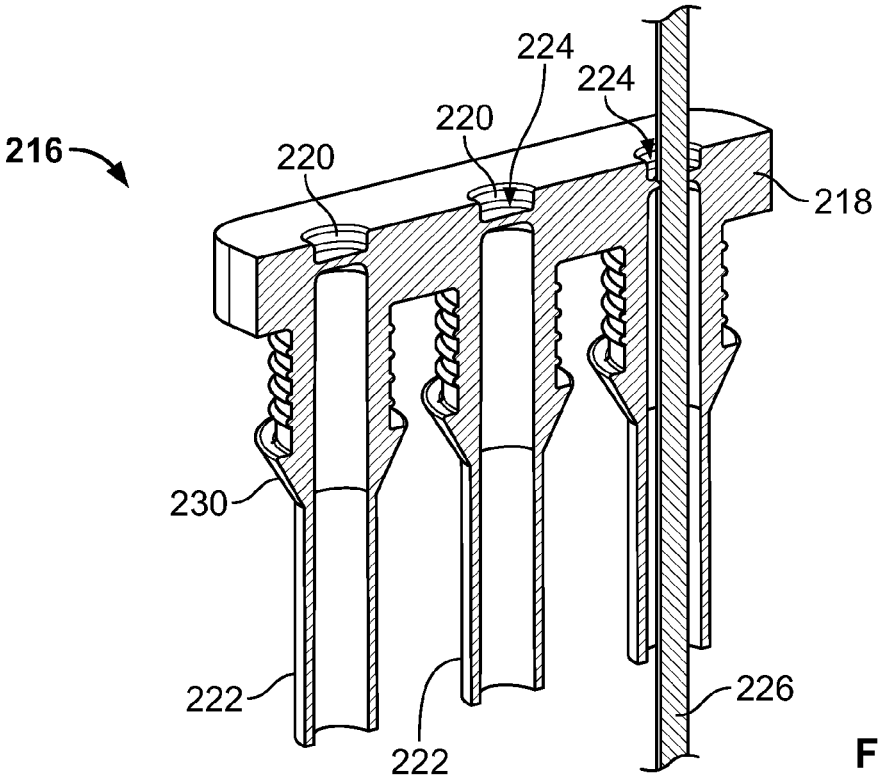
FIG. 6B shows a cross sectional view of an embodiment of the moisture protection screw lead seen in FIG. 6A.

In addition to the moisture seal improvements via the sealing layers 214 seen in FIG. 5, the particularly vulnerable areas of the TEAs that would otherwise be susceptible to moisture permeation due to the presence of holes in the heat sinks have been addressed. Holes are present in the heat sinks to allow for physical and electrical connections, for example, using screws and wires. As can be seen in FIGS. 6A and 6B, a unique wire seal 216 is disclosed. Referring to FIGS. 6A and 6B together, each wire seal 216 comprises a head 218, each head comprising one or more holes 220 in the head 218, through which a wire 226 may pass into a lead 222, each pairing of a hole and lead comprising a membrane 224 that provides a snug seal against any wire 226. The membrane 224 may be a closed permeable membrane that is punctured by a wire during TEA manufacture, or remains intact and impermeable to moisture if a particular hole and lead pairing is unused during TEA manufacture.

For example, the wire seal 216 of FIG. 5 shows a head with six hole and lead pairings arranged in a 2×3 matrix, whereas the wire seal of FIGS. 6A and 6B show a head with three hole and lead pairings arranged in a 1×3 matrix. In the event a 2×3 matrix wire seal is used in a TEA assembly, but only four wires are used, the two unpenetrated membranes will provide a moisture barrier, while the four penetrated membranes will provide a snug seal against any wire passing therethrough. The wire seal 216 may further comprise a shelf 230 that snugly secures the wire seal to the TEA.

Figure 7A:
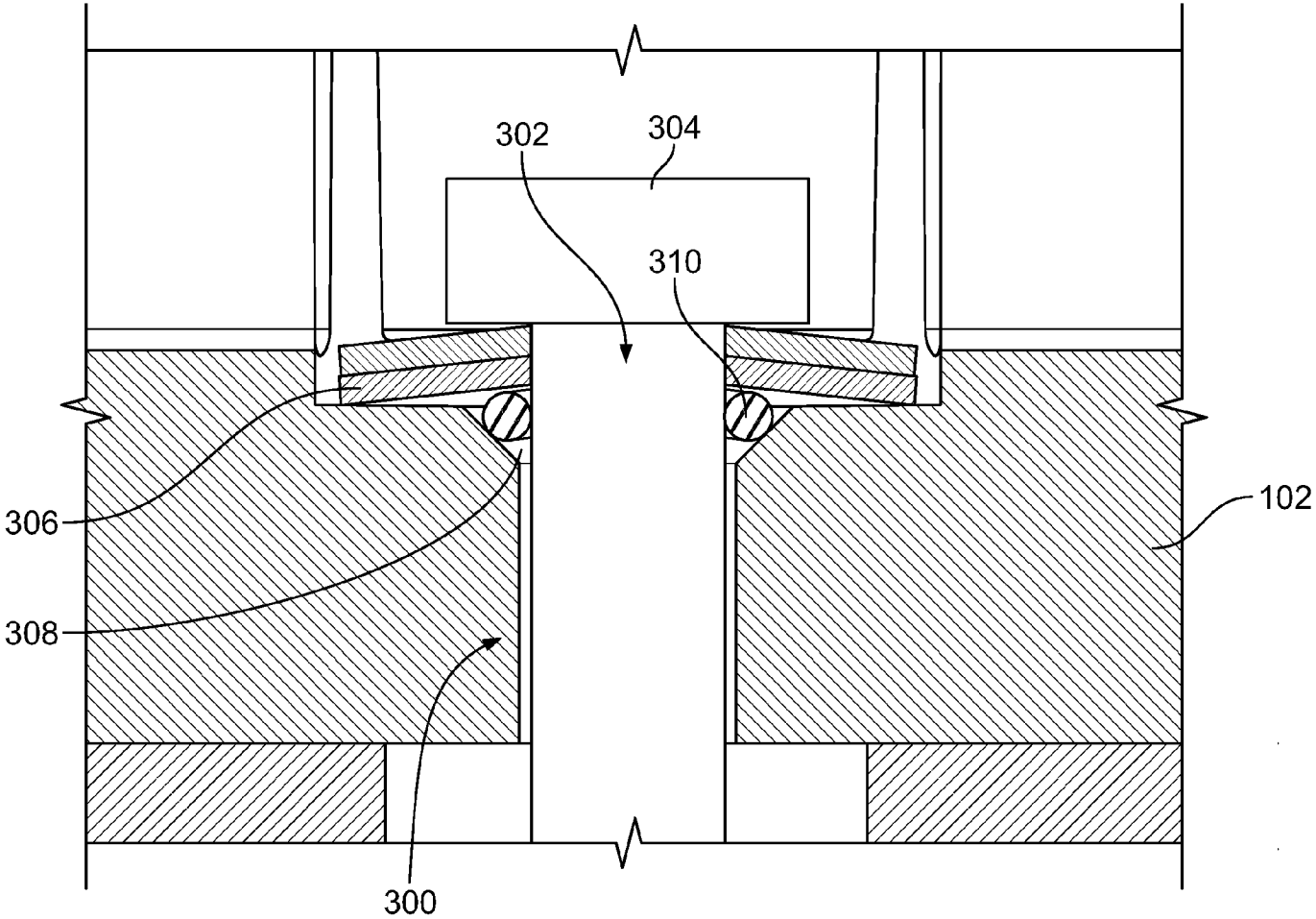
FIG. 7A shows a cross sectional view of an embodiment of a moisture protected screw joint O-ring.
Figure 7B:
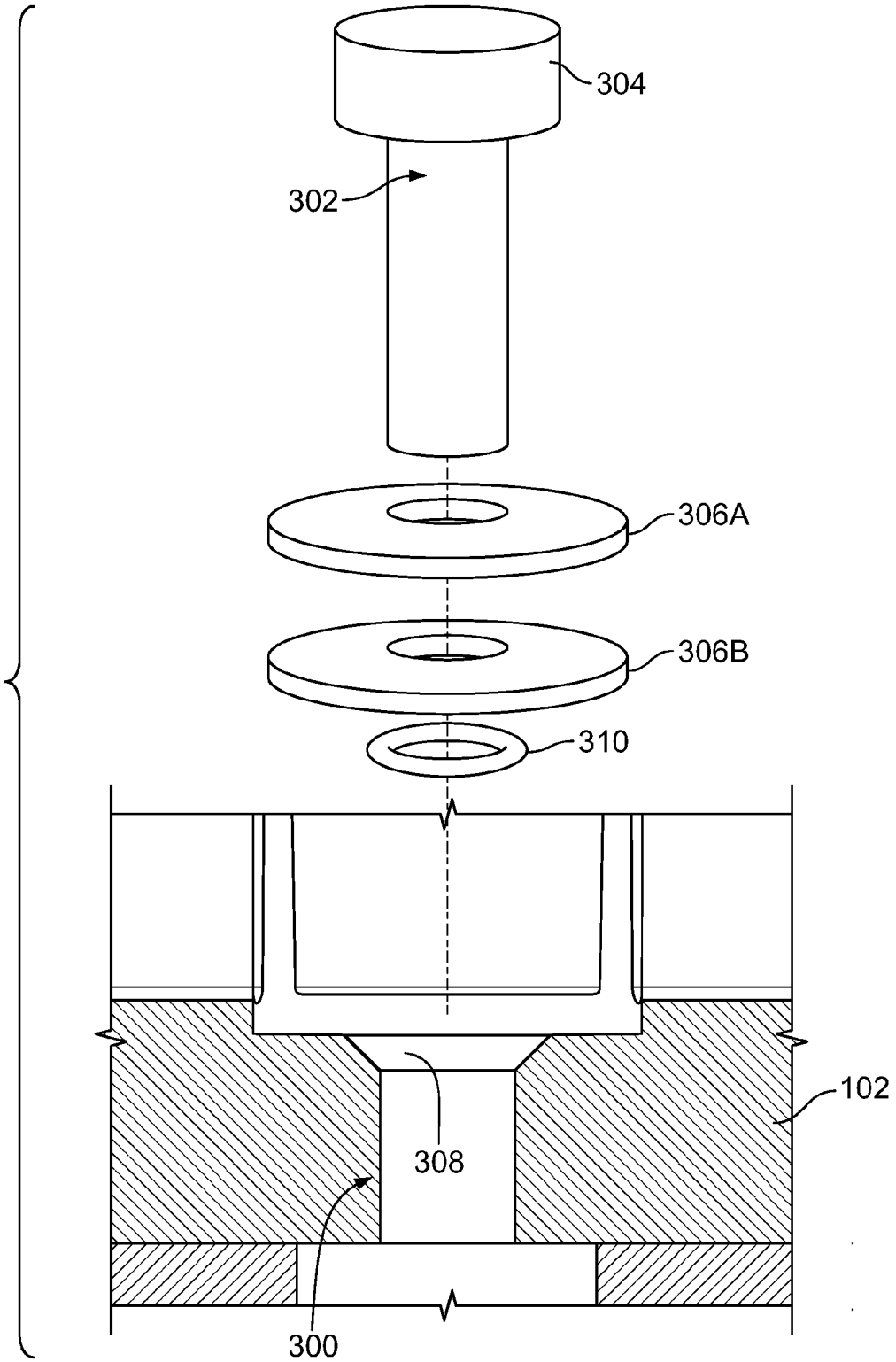
FIG. 7B shows an exploded view of the embodiment of the moisture protected screw joint O-ring seen in FIG. 7A.

Addressing the issue of moisture passing through the screw holes, it was found that creating a frustal surface at the top of a screw hole permitted the insertion of an O-ring below the screw head. This may be seen in FIG. 7, where a cross sectional view of a sealed screw joint is shown. At the bottom of a heat sink 102, a series of screw holes 300 are present to permit the passage of a screw 302 therethrough to secure the TEA's hot side and cold side together. Below each screw head 304, it is common in the art to include one or more disk springs 306 (e.g., disk springs 306A, 306B in FIG. 7B, etc.) or other type of washer. However, in an effort to significantly reduce moisture permeation, the screw hole 300 has been to include a frustal surface 308 within which an O-ring 310 may reside. The presence of the O-ring 310, in conjunction with the other moisture barrier measures discussed herein, substantially eliminates moisture permeation and the malfunctions related thereto.

The TEA may further comprise electrical wiring such that the TEMs, as previously discussed, are in one or more parallel circuits, and sufficient to power the fans. Electrical components and connections may be housed in an electrical bay 202 between the cold side fan sinks 110 as shown in FIG. 3. The TEMs, once sufficient voltage is applied, will pump heat from the cold side heat sink bases to the hot side heat sink base.

Figure 8A:
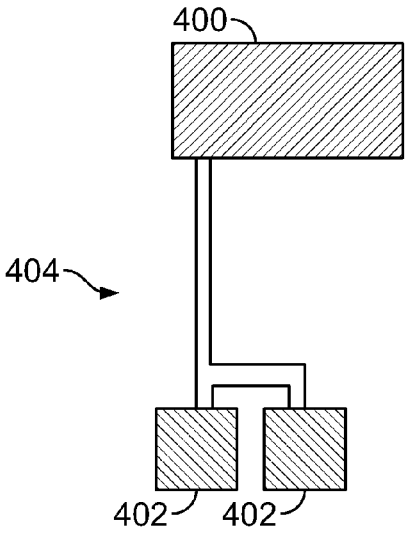
FIG. 8A shows a diagram of an embodiment of a TEA having a single circuit of two TEMs.
Figure 8B:
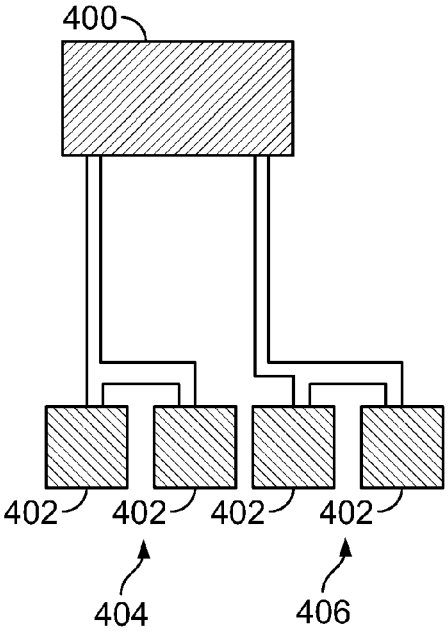
FIG. 8B show a diagram of an embodiment of a TEA having two parallel circuits of two TEMs each.
Figure 8C:
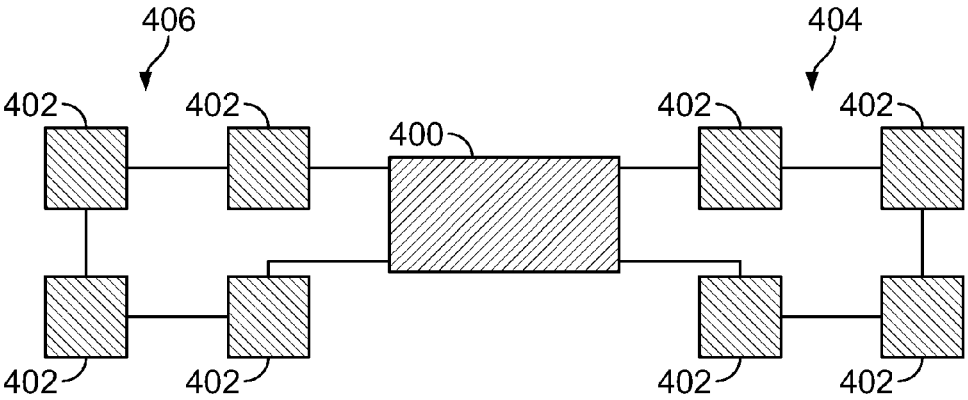
FIG. 8C shows a diagram of an embodiment of a TEA having two parallel circuits of four TEMs each.

Referring to FIG. 8A, the thermoelectric assembly power source 400 may be wired to a single circuit 404 of two thermoelectric modules 402. FIG. 8B shows an embodiment where the power source 400 is wired to two parallel circuits 404, 406, each comprising two thermoelectric modules 402. FIG. 8C shows yet another embodiment of a power source 400 wired to two parallel circuits 404, 406, each comprising a series of four thermoelectric modules 402.

Figure 9:
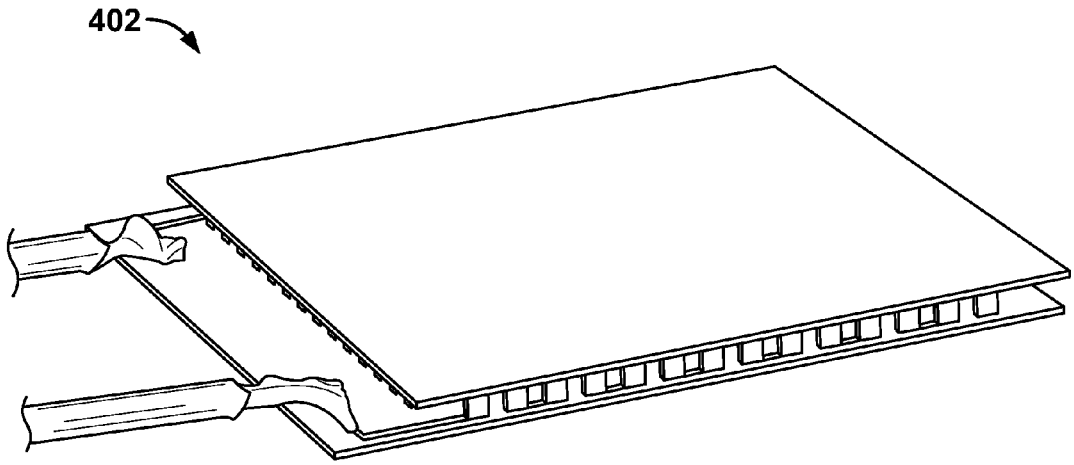
FIG. 9 shows a perspective view of an embodiment of a TEM suitable for use in the present assembly.
Figure 10:
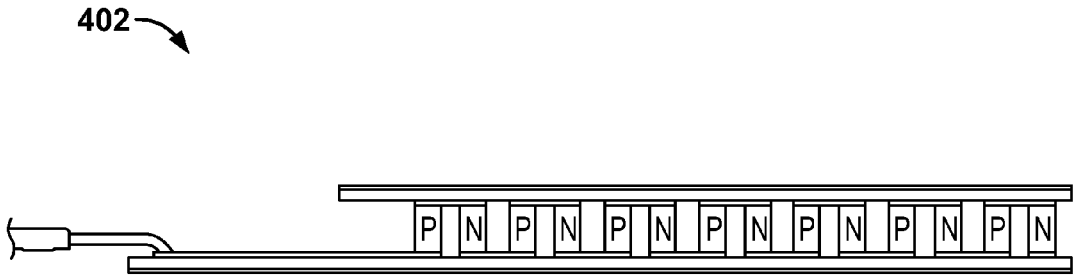
FIG. 10 shows a side view of the embodiment of the TEM seen in FIG. 9.

FIG. 9 shows a perspective view of a thermoelectric module 402 suitable for use in a TEA disclosed herein. A typical thermoelectric module, such as the one depicted in FIG. 9, includes an upper substrate and a lower substrate oriented generally parallel to one another, as well as a positive and negative lead wire attached thereto. FIG. 10 shows a side view detail of the thermoelectric module 402 of FIG. 9. As can be seen in FIG. 10, a TEM includes alternating N-type and P-type thermoelectric elements disposed generally between the upper and lower substrates, these elements formed from suitable materials, such as bismuth telluride for example. Frequently the upper and lower substrates are rectangular in shape, though other shapes may be suitable.

As stated herein, a TEM is considered in direct thermal contact with a heat sink base where a substrate is flush against the base of a heat sink. Frequently the entire surface areas of each substrate of the TEM are covered by a heat sink base to provide optimal thermal transfer. In this manner, the TEMs are sandwiched between two heat sinks, and surrounded by thermally insulating material. It should be understood by one of skill in the art that a TEM and heat sink may be considered in direct thermal contact even in the presence of a thermal grease or paste or other thermal interface material. Such paste (not shown in the Figures) may be, just for example, aluminum oxide particles, or zinc oxide particles, in a silicone carrier.

The assembly need not be limited to only a single hot side fan sink and a pair of cold side fan sinks. Any number of configurations of thermoelectric assemblies that include a plurality of additional fan sinks on both the hot and cold sides are embraced by this disclosure. For example, a thermoelectric assembly may include dual hot side fan sinks that have air output in opposite directions as well as three cold side fan sinks with air output directions in a variety of possible configurations. Additionally, an assembly could have two dual hot side fan sinks as well as dual cold side fan sinks.

The assembly is additionally not limited to single directional output from the cold side fan sinks. A single cold side fan sink may provide two directions of air exhaust in opposite directions, depending on the housing of the fan sink, with the cold side fan sink not exhausting air towards the electrical components that may reside between dual cold side fan sinks. The housing of the cold side fan sink may be open on both ends of the heat sink to permit such dual direction exhaust.

The assembly may be modularly configurable and customizable, potentially either by the end user or the manufacturer, to permit drainage of the cold side heat sink, even where the spatial limitations of the existing structure requires horizontally mounting the assembly.

Replacing the single, large cold side heat sink with two separate cold side heat sinks in the same general footprint that includes a space therebetween did not result in a significant loss of efficiency of the cold side of the assembly or of the assembly as a whole. In contrast to conventional TEAs of the prior art, such as that seen in FIGS. 1A and 1B, the disclosed assembly has removed an inefficient portion of the unit and made use of the resulting space to alleviate the moisture problems known in the art. By eliminating a single, large cold side heat sink, the thermal contraction and expansion associated with TEA operation is reduced, thereby reducing incidence of moisture penetration into the TEA. The stress associated with the expansion and contraction may additionally cause the TEA to be forced out of position, causing unit failures. This change from one large heat sink to two smaller heat sinks additionally relaxes the mechanical tolerance requirements of the heat sink material, thereby reducing material costs. As discussed above, and as can be seen in the Figures, the space between the two cold side sinks may be repurposed as a locale for various electrical components, including the external electrical connections.

The hot side/cold side thermal flow could be reversed in a TEA by merely reversing the current in the TEM circuits, thereby altering the TEM heat flow. The assembly disclosed herein may include a switch that reverses the current of the TEMs without the need to rewire the assembly or the power source into the assembly. Such a reversal of current, however, may not result in equal thermal transfer efficiency in each direction, given variables such as the size, shape, and configuration of the respective heat sinks, as well as other factors.

In summary, among the many benefits of the disclosed device apparent to those of skill in the art from this description, it was discovered that the replacement of a single, large cold side heat sink with a pair of smaller cold side heat sinks provides numerous benefits: reduced moisture penetration by virtue of reduced mechanical stresses from expansion and contraction; reduced incidences of failure by shifting of an installed unit shifting by virtue of those same stresses; less cost in manufacture of heat sinks due to reduced material mechanical tolerance requirements; negligible loss of otherwise expected thermal transfer performance; directional flexibility and modularity of the cold side fan sinks; and the availability of space between the fan sinks for electrical components. Further, the moisture penetration resistance of TEAs has been enhanced through the inclusion of a series of moisture barrier measures, including a sealing layer in or near the plane that defines the hot and cold sides, an O-ring sealed screw joint, and a moisture protected wire seal. These and other benefits meet pressing needs in the art, needs unmet by existing thermoelectric assemblies.

The foregoing description of the embodiments has been provided for purposes of illustration and description. It is not intended to be exhaustive or to limit the claims. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the claims, and all such modifications are intended to be included within the scope of the claims.

What is claimed is:

1. A thermoelectric assembly comprising:

a cold side and a hot side, where a boundary between the hot side and the cold side is generally defined by a plane;

the assembly further comprising a fan sink on the hot side, and a pair of fan sinks on the cold side;

wherein each fan sink comprises a heat sink and a fan, each fan comprising a blade, and each heat sink comprising a heat sink base and a fin set disposed on the heat sink base, each fin set comprising a plurality of substantially parallel planar fins, the fins being aligned in an exhaust direction, the exhaust direction being parallel to the plane, wherein each fan sink is associated with an air intake direction defined by an axis about which the blade is rotatably attached to the fan, the air intake direction being perpendicular to the plane;

the assembly further comprising a plurality of thermoelectric modules, the thermoelectric modules being arranged in at least one electrical circuit, with each thermoelectric module being in thermal contact with the heat sink bases of the fan sinks on both the hot side and the cold side, wherein the air intake directions of the pair of fan sinks on the cold side are substantially parallel vectors; and wherein the angle defined by the exhaust directions of the pair of fan sinks on the cold side is selected from the group consisting of zero degrees, ninety degrees, and one hundred eighty degrees;

the assembly further comprising an electric bay between the pair of fan sinks on the cold side.

2. The thermoelectric assembly of claim 1, further comprising at least one moisture barrier measure, the at least one moisture barrier measure being selected from the group consisting of a wire seal, a series of screw O-rings, and a sealing layer.

3. The thermoelectric assembly of claim 1, further comprising a wire seal including a head having one or more holes through which a wire may pass into a lead, each hole comprising a membrane.

4. The thermoelectric assembly of claim 3, wherein the head comprises a series of holes selected from the group consisting of: three holes arranged in a 1×3 matrix, and six holes arranged in a 2×3 matrix.

5. The thermoelectric assembly of claim 1, comprising a wire seal, a series of screw O-rings, and a sealing layer.

6. The thermoelectric assembly of claim 1, comprising eight thermoelectric modules, the thermoelectric modules being arranged in a one of a plurality of parallel circuits selected from the group consisting of eight circuits of one thermoelectric module each, four circuits of two thermoelectric modules each, and two circuits of four thermoelectric modules each.

7. The thermoelectric assembly of claim 1, wherein the heat sinks comprise a material selected from the group consisting of a thermoplastic, anodized aluminum, or copper.

8. The thermoelectric assembly of claim 1, wherein:

the thermoelectric assembly includes a plurality of fan sinks on the hot side; and/or the thermoelectric assembly includes two fan sinks on the hot side that have opposite exhaust directions; and/or the thermoelectric assembly includes three fan sinks on the cold side.

9. The thermoelectric assembly of claim 1, wherein at least one of the heat sinks comprises a material that has been skived to create the fins.

10. A thermoelectric assembly comprising:

a first fan sink, a second fan sink, and a third fan sink;

wherein each fan sink comprises a heat sink and a fan, each fan comprising a blade, and each heat sink comprising a heat sink base and a fin set disposed on the heat sink base, each fin set comprising a plurality of substantially parallel planar fins, the fins being aligned in an exhaust direction, wherein each fan sink is associated with an air intake direction defined by an axis about which the blade is rotatably attached to the fan;

the assembly further comprising an even numbered plurality of thermoelectric modules, the thermoelectric modules being arranged in two parallel electrical circuits each consisting of an equal number of thermoelectric modules, where the thermoelectric modules reside in a plane defined by the first fan sink on one side of the plane and the second and third fan sinks on the other side of the plane;

where the heat sink base of the first fan sink is in thermal contact with a first side of each of the thermoelectric modules, and where the second fan sink is in thermal contact with a second side of half of the thermoelectric modules, and where the third fan sink is in thermal contact of the second side of the other half of the thermoelectric modules;

wherein the air intake directions of the first fan sink is a substantially parallel vector from that of the second fan sink and the third fan sink; and wherein the angle defined by the exhaust directions of the second and third fan sinks is selected from the group consisting of zero degrees, ninety degrees, and one hundred eighty degrees;

the thermoelectric assembly further comprising at least one moisture barrier measure, the at least one moisture barrier measure being selected from the group consisting of a wire seal, a series of screw O-rings, and a sealing layer.

11. The thermoelectric assembly of claim 10, further comprising a wire seal including a head having one or more holes through which a wire may pass into a lead, each hole comprising a membrane.

12. The thermoelectric assembly of claim 11, wherein the head comprises three holes arranged in a 1×3 matrix or six holes arranged in a 2×3 matrix.

13. The thermoelectric assembly of claim 10, comprising eight thermoelectric modules, the thermoelectric modules being arranged in a series of parallel circuits selected from the group consisting of eight circuits of one thermoelectric module each, four circuits of two thermoelectric modules each, and two circuits of four thermoelectric modules each.

14. The thermoelectric assembly of claim 10, wherein the heat sinks comprise a material selected from the group consisting of a thermoplastic, anodized aluminum, or copper.

15. The thermoelectric assembly of claim 10, wherein at least one of the heat sinks comprises a material that has been skived to create the fins.

16. A thermoelectric assembly for enhancing thermal communication across a conceptual boundary plane having a hot side and a cold side, the assembly comprising:

a plurality of fan sinks including a hot side fan sink and a plurality of cold side fan sinks, each fan sink comprising;

a heat sink including a heat sink base and heat sink fins, the heat sink fins being generally parallel and extending at least in a first air flow direction generally parallel to the boundary plane, and a fan oriented with an axis of rotation along a second air flow direction generally perpendicular to the boundary plane and further oriented with respect to the heat sink such that when air flows in the second air flow direction, air also flows in the first air flow direction;

a plurality of thermoelectric modules electrically coupled to a power source, each thermoelectric module being in thermal contact with the hot side fan sink and at least one cold side fan sink; and a moisture barrier measure;

wherein the second air flow direction for each fan sink is substantially parallel to the second air flow direction of another fan, and the first air flow direction for each cold side fan sink has an angle with regard to the first air flow direction of another cold side fan sink, the angle being selected from the group consisting of zero degrees, ninety degrees and one hundred eighty degrees.

17. The thermoelectric assembly of claim 16, wherein the first air flow direction is an exhaust air flow direction and the second air flow direction is a fan intake air direction.

18. The thermoelectric assembly of claim 16, wherein:

the thermoelectric assembly includes a plurality of hot side fan sinks; and/or the thermoelectric assembly includes two hot side fan sinks that have opposite exhaust directions; and/or the thermoelectric assembly includes three fan sinks on the cold side.

19. The thermoelectric assembly of claim 16, wherein at least one of the heat sinks comprises a material that has been skived to create the heat sink fins.

20. The thermoelectric assembly of claim 16, wherein:

the heat sink of the hot side fan sink comprises a material that has been skived to create the heat sink fins; and the heat sink of at least two of the plurality of cold side fan sinks comprises a material that has been skived to create the heat sink fins.

* * * * *